343-700 MS AU 254 EX
8/30/83 OR 4,401,988

United States Patent [19]
Kaloi

[11] 4,401,988
[45] Aug. 30, 1983

[54] COUPLED MULTILAYER MICROSTRIP ANTENNA

[75] Inventor: Cyril M. Kaloi, Thousand Oaks, Calif.

[73] Assignee: The United States of America as represented by the Secretary of the Navy, Washington, D.C.

[21] Appl. No.: 297,490

[22] Filed: Aug. 28, 1981

[51] Int. Cl.[3] ..... H01Q 1/38
[52] U.S. Cl. ..... 343/700 MS
[58] Field of Search ..... 343/700 MS, 705, 708, 343/829, 830

[56] References Cited

U.S. PATENT DOCUMENTS 4,070,676 1/1978 Sanford ..... 343/829
4,218,682 8/1980 Frosch ..... 343/830
4,329,689 5/1982 Yee ..... 343/829

*Primary Examiner*—Eli Lieberman
*Attorney, Agent, or Firm*—Robert F. Beers; Joseph M. St. Amand

[57] ABSTRACT

A coupled multilayer microstrip antenna having an upper and a lower microstrip element tuned to the same frequency, and separated from each other by a dielectric substrate. The pair of elements is located over a suitable ground plane and separated from the ground plane by a second dielectric substrate. The upper element is the driven element which is directly coupled to the feed line while the lower element is parasitically coupled to upper element. The lower element cancels the image field as seen by the upper element providing enhanced radiation at angles closer to the ground plane.

12 Claims, 7 Drawing Figures

COUPLED MULTILAYER MICROSTRIP ANTENNA

BACKGROUND

This invention relates to microstrip antennas which are conformable and have a low physical profile, and can be arrayed to provide near isotropic radiation patterns.

Compact missile-borne antenna systems require complex antenna beam shapes. At times, these beam shapes are too complex to obtain with a single antenna type such as slots, monopoles, microstrip, etc., and requires a more expensive phased array.

Studies indicate that a less expensive approach can be realized in a multi-mode antenna. A multi-mode antenna is a design technique that incorporates two or more antenna types into one single antenna configuration, and uses the unique radiation pattern of each antenna type to provide a combined desired radiation pattern. This requires techniques for exciting two or more antenna modes with one single input feed and also for controlling the excitation of the mode of each antenna type in order to better shape the combined radiation pattern.

There are various prior type multilayer microstrip antennas. However, all these prior antennas are multiresonant having frequencies intentionally tuned apart and are not for the purpose of radiation enhancement of the same frequency. The prior antennas use either a plurality of feeds or a variety of antenna element sizes and shapes to provide multifrequency, or wide bandwidth.

SUMMARY

The present antenna is one of a family of coupled microstrip antennas. Coupled microstrip antennas have been used in multifrequency and wide bandwidth applications. This invention uses multicoupled microstrip antennas for improving the pattern characteristics of the antenna.

The coupled multilayer microstrip antenna of this invention uses two microstrip elements, an upper and a lower element tuned to the same frequency, separated from each other by a dielectric substrate. The pair of elements is located over a suitable ground plane and separated from the ground plane by a second dielectric substrate. The upper element is directly coupled to the microwave transmission feed line while the lower element is parasitically coupled to upper element. The lower element cancels the image field as seen by the upper element providing enhanced radiation at angles closer to the ground plane.

The coupled multilayer antenna can be used in missiles, aircraft and other type application where a low physical profile antenna is desired.

The present antenna structure is readily formed from conductor clad dielectric substrate using conventional photo-etching and laminating processes similar to those used in manufacturing printed circuits. The antenna elements can be arrayed to provide near isotropic radiation patterns for telemetry, radar, beacons, tracking, etc. By arraying the present antenna with several elements, more flexibility in forming radiation patterns is permitted. Due to its conformability, this antenna can be applied readily as a wrap around band to the missile body without the need for drilling or injuring the body and without interfering with the aerodynamic design of the missile.

DESCRIPTION AND OPERATION

Figure 1:
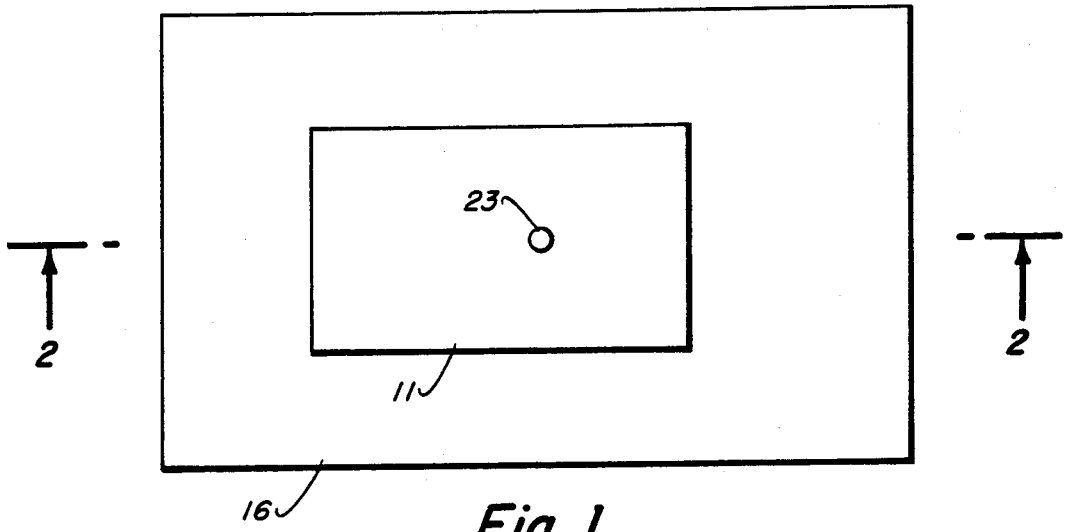
FIG. 1 is a top planar view of a typical asymmetrically fed coupled multilayer microstrip antenna.
Figure 2:
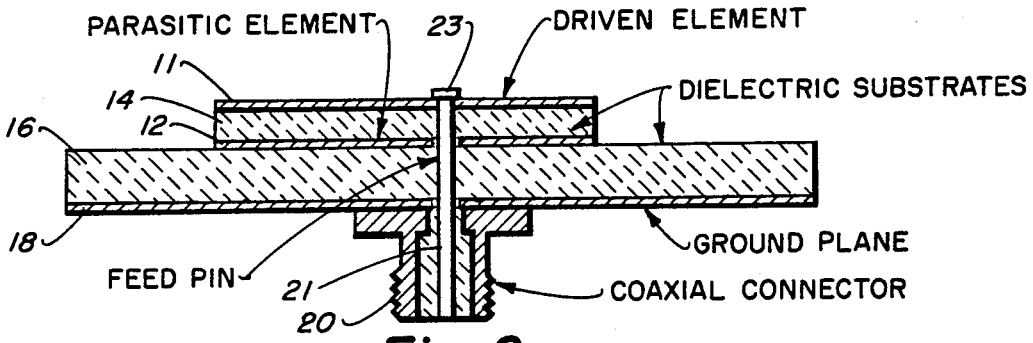
FIG. 2 is a cross-sectional view of a typical coupled multilayer microstrip antenna, taken along line 2—2 of FIG. 1.
Figure 3:
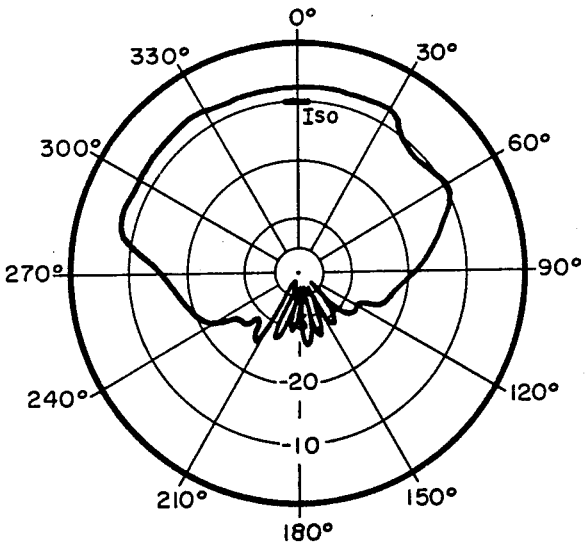
FIG. 3 shows a typical H-plane radiation pattern for the coupled multilayer microstrip antenna.
Figure 4:
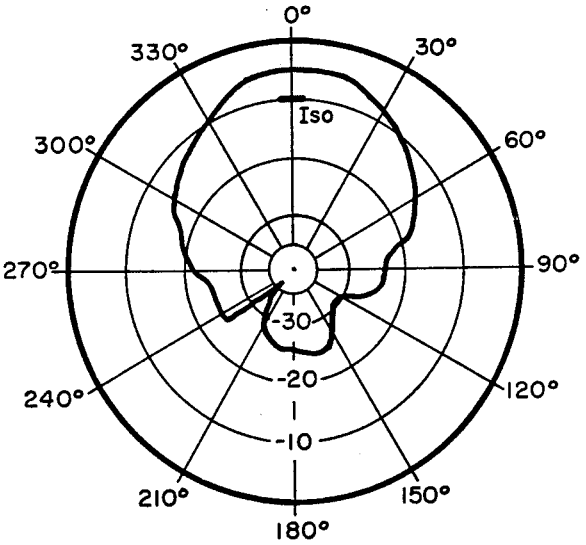
FIG. 4 shows a typical H-plane radiation pattern for a single element microstrip antenna.

FIGS. 1 and 2 show schematic views of a coupled multilayer microstrip antenna. This antenna configuration uses two microstrip elements 11 and 12, having the same dimensions, separated by a dielectric substrate 14 and tuned to the same frequency to provide a multimode antenna. The upper element 11 is directly coupled to the microwave transmission line whereas the lower element 12 is parasitically coupled to the upper element 11. The element pair 11 and 12 is laminated to another substrate 16 and located over a suitable ground plane 18. The lower element 12 provides a field that, in essence, cancels the image field as seen by the upper element 11. The result is enhanced radiation at angles closer to the ground plane. This enhancement is more pronounced in the H-plane and not as significant in the E-plane. FIG. 3 shows a typical H-plane radiation pattern for the coupled multi-layer microstrip antenna, and as a comparison, a similar pattern is shown in FIG. 4 for a single element.

The separation between the parasitic element 12 and the driven element 11 should be minimized. Large separations between the parasitic element 12 and driven element 11 reduces the coupling and therefore reduces the canceling effects of the image field as seen by the upper element. The separation between the parasitic element 12 and the driven element 11 also affects the bandwidth of the driven element. Large separations improve the bandwidth (large bandwidth) and small separations degrade the bandwidth (narrower bandwidth). Therefore, the separation between the parasitic element 12 and the driven element 11 is chosen based on bandwidth versus pattern characteristic improvements. In most cases, however, sufficient coupling will be available for most thicknesses of dielectric 14 (bandwidth) chosen.

The separation between the parasitic element 12 and the driven element 11 should be approximately the same as the separation (i.e., dielectric substrate 16 thickness) between the ground plane 18 and the parasitic element 12, in order to maintain the same cavity volume in both the parasitic element and the driven element (i.e., maintain approximately the same bandwidth). Under some conditions, however, different spacings can be used. As in most microstrip antennas, a larger cavity thickness also improves the efficiency of the antenna. There is a threshold where further increase in thickness will not improve efficiency, and this is dependent on frequency and copper and dielectric losses.

The coupled multilayer microstrip antenna shown in FIGS. 1 and 2 is fed from a coaxial-to-microstrip adapter 20 with the center pin 21 (i.e., feed pin) of the adapter extending through the ground plane 18, two layers of dielectric substrate 14 and 16, the parasitic element 12 (without any interconnection), and to the feed point 23 on the driven (i.e., upper) element 11. In the example shown, the feed point 23 is located along the centerline of the antenna length (i.e., same as line 2—2). While the input impedance will vary as the feed point 23 is moved along the centerline between the antenna center point and the end of the antenna in either direction, the radiation pattern will not be affected by moving the feed point. The exact location of the feed point 23 for optimum match must be determined experimentally, since there are no design equations available to analytically locate the feed point.

The width of both the parasitic and the driven elements should be made less than the length of both elements in order to reduce cross polarization modes of oscillation.

Since it is necessary that both elements resonate at the same frequency, slight adjustments in the dimensions of elements 11 or 12 may be made to assure degenerate frequency operation of the antenna.

Figure 5:
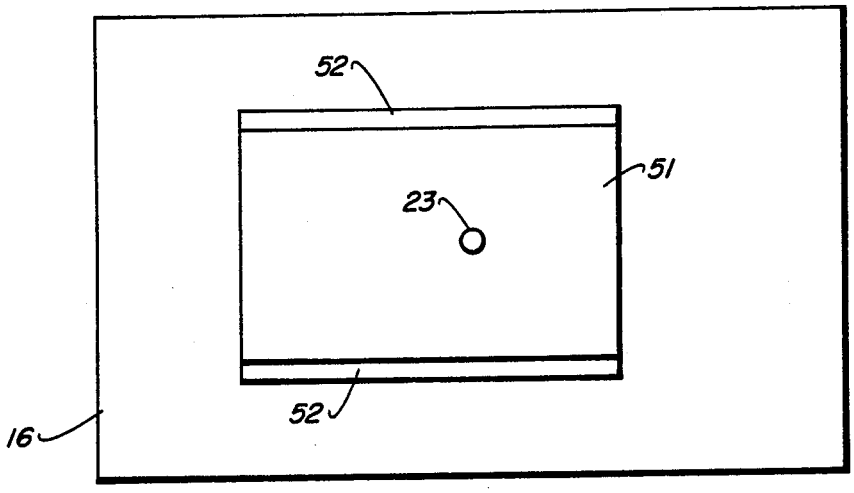
FIG. 5 is a planar view showing a typical coplanar multilayer single frequency microstrip antenna where the upper or driven element is dimensioned slightly smaller than the lower or parasitic element.

Although it is not necessary for both the parasitic element and driven element widths to be equal, if one element is to be smaller than the other, it is preferred that the driven element be smaller or narrower than the parasitic element in order to minimize coupling from the driven element to ground. FIG. 5 shows a planar view of a typical coupled multilayer microstrip antenna where the driven (i.e.. upper) element 51 is slightly smaller than the parasitic (i.e., lower) element 52. In this case element 51 is narrower than element 52. Narrowing of the element widths are limited by the losses (i.e., copper losses) involved. To compensate for any change in resonant frequency due to narrowing the driven element width, the thickness of substrate 14 can be varied, as discussed below.

The length of the antenna elements determines the antenna resonant frequency. The lengths of the driven and parasitic elements of the antenna may be varied slightly to have them resonate at the same frequency, as is discussed below.

Both the driven element 11 and the parasitic element 12 operate in a degenerate mode, i.e., both of the elements oscillate at the same frequency. Although the length determines the resonant frequency of the parasitic element, the thickness of the substrate 14 between the driven element 11 and the parasitic element 12 can affect the driven elements' resonant frequency. For example, reducing the substrate thickness provides and effective lengthening, and increasing the substrate thickness provides an effective shortening of the parasitic element 12, thus requiring the parasitic element to be dimensioned slightly shorter or longer, respectively, as the case may be. Furthermore, the mutual coupling due to the driven element provides a mutual impedance at the parasitic element. The reactive component of this mutual impedance in turn provides an effective lengthening or effective foreshortening of the parasitic element, thus requiring the parasitic element to be dimensioned longer or shorter. Which of these phenomena has the most affect on the antenna has not yet been determined.

Figure 6:
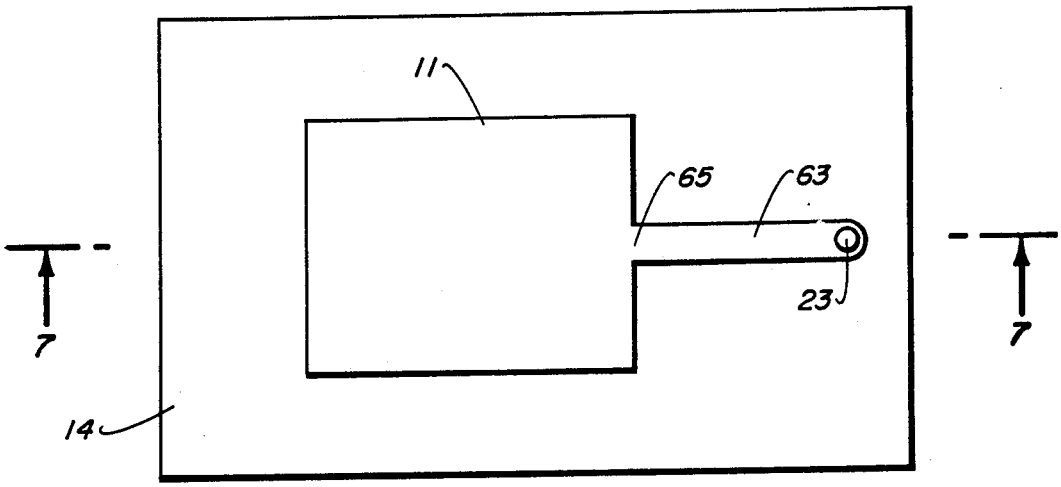
FIG. 6 is a planar view of a typical coupled multilayer microstrip antenna with coplanar feed.
Figure 7:
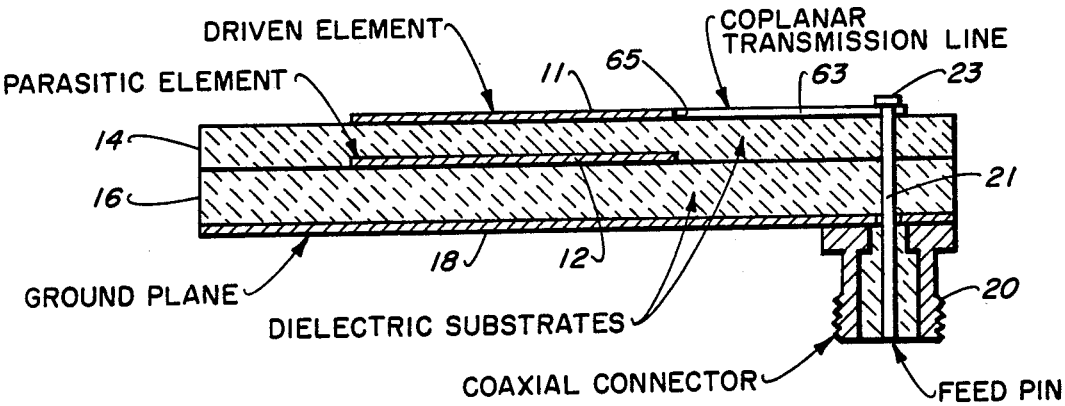
FIG. 7 is a cross-sectional view taken along line 7—7 of FIG. 6.

The coupled multilayer antenna can also be fed from a coplanar microstrip transmission line feed system, and the feed point can be located in various positions: asymmetrically using a notch, or at the end of the driven element, along the edge, etc. A typical coplanar end fed antenna of this type is shown in FIGS. 6 and 7, by way of example. In using the coplanar feed system configuration, the overall dielectric thickness of both dielectric substrates 14 and 16 must be taken into consideration, i.e., the microstrip transmission line 63 connected to a feed point 65 at the end of driven element 11 will be referenced to the ground plane 18 rather than to the parasitic element 12.

Typical design equations for dimensioning the elements and various techniques for feeding the driven element can be found in U.S. Pat. No. 3,947,850, issued Mar. 30, 1976, for Notch Fed Electric Microstrip Dipole Antenna; U.S. Pat. No. 3,972,049, issued July 27, 1976, for Asymmetrically Fed Electric Microstrip Dipole Antenna; U.S. Pat. No. 3,978,488, issued Aug. 31, 1976, for Offset Fed Electric Microstrip Dipole Antenna; U.S. Pat. No. 3,984,834, issued Oct. 5, 1976, for Diagonally Fed Electric Microstrip Dipole Antenna, and U.S. Pat. No. 4,117,489, issued Sept. 26, 1978, for Corner Fed Electric Microstrip Dipole Antenna, all by Cyril M. Kaloi.

Obviously many modifications and variations of the present invention are possible in the light of the above teachings. It is therefore to be understood that within the scope of the appended claims the invention may be practiced otherwise than as specifically described.

What is claimed is:

1. A coupled multilayer microstrip antenna for improving antenna radiation pattern characteristics, comprising:

a. a thin ground plane conductor;

b. a first thin planar conducting microstrip radiating element (parasitic element) being spaced from and parallel to said ground plane;

c. said parasitic element being separated from said ground plane by a first dielectric substrate;

d. a second thin planar conducting microstrip radiating element (driven element) being spaced from and parallel to said parasitic element such that said parasitic element is located between said ground plane and said driven element;

e. said driven element being separated from said parasitic element by a second dielectric substrate;

f. said driven element and said parasitic element each being tuned to the same frequency;

g. said driven element having at least one feed point located thereon; said feed point being directly coupled to and fed energy from a microwave transmission line;

h. said parasitic element being parasitically coupled to the driven element without any direct connection thereto; said parasitic element operating to cancel the image field as seen by the driven element to provide enhanced radiation at angles closer to said ground plane.

2. A coupled multilayer microstrip antennas as in claim 1 wherein said feed point on the driven element is fed from said transmission line by a coaxial adapter; the center pin of said coaxial adapter extending through said ground plane, said first and second dielectric substrates, and said parasitic element without any interconnection thereto, to said feed point.

3. A coupled multilayer microstrip antenna as in claim 1 wherein said feed point on said driven element is fed from a coplanar microstrip transmission line feed system.

4. A coupled multilayer microstrip antenna as in claim 1 wherein the spacing between said driven element and said parasitic element is minimized to provide increased coupling between said elements.

5. A coupled multilayer microstrip antenna as in claim 1 wherein the spacing between said driven element and said parasitic element is varied to vary the bandwidth of said driven element.

6. A coupled multilayer microstrip antenna as in claim 1 wherein the spacing between said driven element and said parasitic element is approximately equal to the spacing between said parasitic element and said ground plane to maintain approximately the same bandwidth in both said elements.

7. A coupled multilayer microstrip antenna as in claim 1 wherein the widths of both said driven and parasitic elements is less than the length of said elements.

8. A coupled multilayer microstrip antenna as in claim 1 wherein said driven element is any of equal to and smaller in size than said parasitic element to minimize coupling from said driven element to the ground plane.

9. A coupled multilayer microstrip antenna as in claim 1 wherein the lengths of said driven and parasitic elements are varied slightly from each other as adjustment means for said elements to resonate at the same frequency.

10. A coupled multilayer microstrip antenna as in claim 1 wherein the effective length of the parasitic element is varied by varying the location of said driven element above said parasitic element which operates to vary the resonant frequency of said parasitic element and in turn causes a change in the effective length thereof.

11. A coupled multilayer microstrip antenna as in claim 1 wherein said parasitic element is dimensioned slightly longer than said driven element to allow for the mutual coupling of said driven element to said parasitic element that provides a mutual impedance at said parasitic element which operates to cause an effective foreshortening of the parasitic element.

12. A coupled multilayer microstrip antenna as in claim 1 wherein said driven element and said parasitic element are substantially the same dimension.

* * * * *